US007380691B2

(12) United States Patent
Kroll et al.

(10) Patent No.: US 7,380,691 B2
(45) Date of Patent: Jun. 3, 2008

(54) CAP SHAPE SUPPORTING AND FORM MAINTAINING DEVICE, AKA "HATNOODLE" AND METHOD OF STORAGE FOR CAP

(76) Inventors: Gregory Arthur Kroll, 4921 Cass St., Omaha, NE (US) 68132-2912; Travis Lee Wilson, 3605 Newton St., Hayes, VA (US) 23072; Arthur Thomas Kroll, 830 Woodbine Ave., Oak Park, IL (US) 60302

( * ) Notice: Subject to any disclaimer, the term of this patent is extended or adjusted under 35 U.S.C. 154(b) by 285 days.

(21) Appl. No.: 11/208,201

(22) Filed: Aug. 20, 2005

(65) Prior Publication Data

US 2006/0049220 A1 Mar. 9, 2006

Related U.S. Application Data

(60) Provisional application No. 60/605,341, filed on Aug. 27, 2004.

(51) Int. Cl.
*A42C 1/04* (2006.01)

(52) U.S. Cl. ..... 223/12; 223/7

(58) Field of Classification Search ..... 223/7–26, 223/120

See application file for complete search history.

(56) References Cited

U.S. PATENT DOCUMENTS

| | | | | | |
|---|---|---|---|---|---|
| 39,299 | A | * | 7/1863 | Masker | 223/24 |
| D59,887 | S | | 12/1921 | Freeman | |
| 2,283,660 | A | | 5/1942 | Widmann | |
| 2,536,913 | A | | 1/1951 | Cox | |
| 2,577,167 | A | | 12/1951 | Vlasis | |
| 4,858,247 | A | | 8/1989 | Hooser | |
| 4,998,992 | A | * | 3/1991 | Richlin et al. | 223/66 |
| 5,012,531 | A | | 5/1991 | Schoonover | |
| 5,148,954 | A | * | 9/1992 | Myers | 223/25 |
| D364,496 | S | | 11/1995 | Lejuez | |
| 5,725,134 | A | * | 3/1998 | Weltge | 223/24 |
| D437,473 | S | | 2/2001 | Preddy | |
| D441,174 | S | | 5/2001 | Farbenbloom | |
| 6,253,973 | B1 | | 7/2001 | Jones | |
| 6,311,879 | B1 | | 11/2001 | Rigler | |
| 6,523,728 | B2 | | 2/2003 | Lee | |
| 6,648,189 | B1 | | 11/2003 | Minton | |

* cited by examiner

*Primary Examiner*—Gary L. Welch
*Assistant Examiner*—Andrew W Sutton
(74) *Attorney, Agent, or Firm*—James F. Popelka

(57) ABSTRACT

A shape supporting and form maintaining device, known as a "HatNoodle", for a cap. The cap includes two components, an essentially hemispherical crown component and an attached visor component. The aforementioned "Hat-Noodle" device is constructed from a resilient material and includes a bottom surface and an essentially convex top surface. The bottom surface may contain a plurality of insertion holes that extend into, but not completely through, the material of the device and are used when installing the device into a cap. The top surface of the device contains a plurality of compliance slots wherein each compliance slot begins at the center of the top surface of the device and proceeds outward in a radial direction. The compliance slots facilitate installing a cap onto the device. These compliance slots also allow the device to better conform to the shape of the inside surface of the crown of the cap hat it resides within.

2 Claims, 5 Drawing Sheets

CAP SHAPE SUPPORTING AND FORM MAINTAINING DEVICE, AKA "HATNOODLE" AND METHOD OF STORAGE FOR CAP

CROSS REFERENCE TO RELATED APPLICATIONS

The present application is a non-provisional patent application claiming the benefit, under 35 U.S.C. 119(e), of U.S. Provisional Patent Application Ser. No. 60/605,341, filed Aug. 27, 2004, herein incorporated by reference.

FIELD OF THE INVENTION

The present invention relates to a shape supporting, or form-maintaining device for a cap, particularly for a baseball cap, sports cap or similar cap. Specifically, the present invention relates to a shape supporting and form maintaining device for baseball, sports or similar caps that includes a capability to adjust its size and form to the cap's size and form. Even more specifically, the present invention relates to a shape supporting and form maintaining device for baseball, sports or similar caps that includes a plurality of slots in its top surface that allow said device to adjust its size and form to fit the cap's size and form.

BACKGROUND OF THE INVENTION AND DESCRIPTION OF RELATED ART

Many items, products and articles of apparel made of cloth, leather and other natural and artificial fabrics and materials and combinations of such materials possess a characteristic shape and form that is both functional and aesthetically pleasing. During the manufacturing or fabrication of such items, products or articles of apparel, special processes, operations, components, fixtures and procedures are incorporated and used to create, preserve and maintain this characteristic shape. One such example is the inclusion or use of stiffening structures or compounds such as adding a stiffened backing material to a component or article for the purpose of stiffening a panel or section that is subject to folding, creasing or crushing pressures. Another example is the common practice of adding stiffness to a fabric by starching it. Other processes, operations, components, fixtures and procedures are included in the manufacturing or fabricating process to not only define and establish the form and shape of these items when they are sold, but to protect and maintain that shape as long as possible afterward.

From the effort and cost associated with implementing these shape supporting and form maintaining measures, it may be inferred that producing a product with an aesthetically pleasing appearance is a primary goal of the manufacturing or fabrication process. It may also be inferred that another primary goal of the manufacturing or fabrication process is to ensure that the item will retain its characteristic and aesthetically pleasing shape and form while subject to the rigors of use, transportation and storage.

The inclusion and incorporation of the processes, operations, components, fixtures and procedures to establish and preserve the shape and form of articles and items of apparel are indicative of the desire of the user to not only purchase attractive and well-formed items, but to maintain them in that same pleasing form thereafter. In view of this desire by the purchaser or user to obtain a well-formed and shaped item and to keep that item in the same pristine condition as when purchased, it can be concluded that a large portion of the value of the item resides in its shape and appearance. The cost of the special processes, components, fixtures and procedures used in the manufacture of the articles, products and items of apparel is justified by the additional value imparted to the end product. That value can be diminished or lost when the appearance of the product is damaged or changed through even careful use, transport or storage of the articles, products and items of apparel.

An example of such an item, product or article of apparel is the baseball cap. The term "baseball cap", or even just the word "cap", is intended in this application intended to also include sports and similar caps. These caps include a wide variety of different shapes and configurations and are manufactured from an equally wide variety of fabrics and materials. Such caps may include a visor or bill, or be visorless. They may be essentially hemispherical in shape, or non-hemispherical. Many more options and variations are available, including but not limited to, colors, materials, size, incorporation of decorative insignia or devices, etc.

The prototype for what can be considered the standard variety of baseball or sports cap in use today is the "Brooklyn" or "5950" baseball cap. This model traces its origin to the 19th century when it was introduced as an alternative to the berets, derby caps and the like worn by various baseball teams and players. From this introduction, the baseball cap, and again this includes sports caps and other styles of visored or visorless, brimmed or brimless, hemispherical shaped or non-hemispherical shaped caps, has developed and evolved from a non-essential baseball uniform option into the ubiquitous and utilitarian fashion accessory it is today. It can be said with some truth that the baseball, or sports, cap has essentially supplanted most, if not all, other styles and varieties of men's hats for daily wear.

In one of its common implementations, a baseball cap includes two main sections, the crown and the visor. The crown of a baseball or sports cap may have a hemispherical shape that may or may not be elongated to better fit the head of the user. Many variations of this basic form, such as caps with cylindrically shaped crowns, exist. A visor is often attached to the front of the cap at the base or brim of the crown to shield the wearer's eyes from the sun.

When a quality cap is purchased, it normally possesses a shape and form that exemplifies the aesthetically pleasing characteristics desired by the purchaser. The cap may be purchased for wearing, to be placed in a cap collection or even to be included as a component in an artistic display of sports equipment and/or memorabilia. Regardless of the intended use of the cap, the purchaser would like to maintain the cap in the same pristine condition as when it was purchased.

Maintaining the desired shape and form of a cap after purchase can be very difficult because of the demands placed on the cap when it is worn, transported or stored. Even determining how to store a cap in such a way as to preserve its form and shape can be a problem. Simple expedients for cap storage such as hanging it from a coat hook or placing it on a hat or coat rack can eventually cause the crown of the cap to stretch and deform with time. Merely storing the cap on a shelf or on some other flat surface may cause the crown to sag and lose its shape.

Wearing a cap may cause the crown to become deformed or to lose its shape. Transporting the cap in a piece of luggage, a gym bag, or another container may cause the crown to become crushed, wrinkled or deformed, marring the cap's appearance. These issues clearly indicate the need for a device whose functions go beyond preserving the shape of a cap's crown. A device is needed that can help to preserve the characteristic shape and form of the crown cap's crown when it is not being worn while at the same time facilitating the restoration of the shape of the cap's crown after the cap has been crushed or deformed.

Baseball caps become dirty and soiled through use, transport or storage and may need to be washed or laundered from time to time. Also, a cap may become wet during use. If a laundered or wet cap is not dried properly, the crown can become deformed and lose its shape. There exists a need for a device to be employed to form and shape the cap's crown during the drying process. This problem is separate from the problem of maintaining the shape of the visor of a cap, if one is present.

Some inventions have been proposed that have attempted to address the various aspects of the shape maintaining or shape enforcement problem faced by the hat owner. Schoonover (U.S. Pat. No. 5,012,531) describes a case or holder for a cap that attempts to maintain the shape or form of the hat while it is being transported. This solution is not optimal because it requires the user to fold the crown of the cap in order to use the device.

Weltge (U.S. Pat. No. 5,725,134) describes a method of using a device made of a resilient, compressible material to retain the shape of a baseball, sports or similar cap. The method and device do not require the user to fold the crown of the cap. However, the method patented and the device disclosed in the patent do not incorporate methods, procedures, structures or devices that address the problem caused by the exertion of excessive force by the device against the inner surface of the crown of the cap during the insertion process. This force can make the device difficult to insert and can distort or damage the shape of the cap. Additionally, the apparatus mentioned in Weltge is shown incorporating a plurality of ventilating holes extending through the material of the disclosed device. When the disclosed device is in use, the holes are pressed against the inner surface of the crown of the cap and may wrinkle or deform the cap. The use of these holes to compress the material of the device during its insertion into a cap is of questionable value. The compressive force exerted upon the holes by the user's fingers during insertion is directed toward the center of the device. Any force acting to compress the top surface of the device is communicated from this central area by pulling and stretching the device's material. This pulling and stretching of the material may cause the shape of the device to be permanently deformed and may even result in the central material tearing free from the rest of the device. In addition. Weltge's device contains no aspects or features that reduce the pressure the device exerts on the brim of the cap without distorting the essentially circular or oval shape of the brim, both while it is being inserted into a cap and while it is in place in the cap. This pressure can deform the brim of the cap, or it may distort or damage the cap size adjustment feature often incorporated into the brim of a cap.

Richilin (U.S. Pat. No. 4,998,992) describes a wig stand with ventilation channels. These channels begin at the base of the device, extend upwards along the device's sides and join with other channels on the top surface. The channels provide air circulation paths along the inside surface of a wig placed on the device for air that traverse the inner surface of a wig placed on the device. In order to provide entry and exit portals for the circulating air, the channels must begin and end at the base of the device. One reason such a wig stand would not be suitable for use with a sports cap is that the channels, due to their round shape and their positioning on the surface of the device, would not allow the device as a whole to properly flex during the insertion process, easing the insertion of the device into a cap. Another reason is that the channels, by their need to originate and terminate at the base of the device, would create irregularities in the surfaces of the device that contact the inside surface of the cap. This probably would create wrinkles and creases in a cap placed upon it. This possibility of causing creases and wrinkles is especially troublesome for the front area of the sports cap, where a logo or design is usually displayed. Richilin's design shows channels traversing this critical logo area.

Minton (U.S. Pat. No. 6,648,189) discloses a device similar to that shown in Weltge. Both patents require the use of a compressible material to allow insertion of the device into a cap by squeezing it to compress its size, inserting it and then releasing it to allow it to regain its former shape. There are two problems with this approach. One of the problems is that compressing the device for insertion requires significant effort and could prove difficult to properly accomplish. A second problem is that the pressure exerted against the inside surface of the crown of the cap during the insertion process may be excessive, causing fatigue and perhaps damage to the hat. Also, the feature of the device disclosed in Minton that requires the material of the device to extend below the brim of the cap when it is in place, making it visible when inserted, could preclude its use when the hat is to be displayed for viewing with the device in place. The device disclosed also does not contain aspects or features to prevent or reduce pressure on the brim of the cap or any adjustment mechanism incorporated in the brim.

The hat shaping arrangement described in Jones (U.S. Pat. No. 6,253,973) discloses an inflatable bladder that is placed inside the crown of the cap and then inflated to shape or form a cap. This patent additionally discloses a pump used to inflate the arrangement and valving used both to contain the air held within and to control the release from the bladder as needed.

Hooser (U.S. Pat. No. 4,858,247) and Myers (U.S. Pat. No. 5,148,954) disclose inventions that are cut from a flat sheet of material and then bent into a circular form and fitted into the crown of the cap. The construction and use of the disclosed inventions indicates that the devices themselves could be crushed during the storage and transport of a cap. The inventions also require considerable configuration or setup before they can be fitted into cap and may not be suitable for frequent use.

Other devices, apparatus and arrangements such as the device described in Rigler (U.S. Pat. No. 6,311,879) address the problem of protecting the shape of the cap's visor. This visor is normally attached to the brim of the cap. Devices, apparatus or methods that protect the visor do not necessarily include aspects or features that protect the shape and form of the hat crown. Other devices that do protect the crown of the cap may not necessarily allow the cap to be displayed while the device is in place.

Using a simple convex, spherically or hemispherically shaped device could provide a solution that could protect and maintain the shape and form of a cap's crown. However, such a simple shape could prove difficult to insert into the cap's crown. If a hollow spherical or hemispherical device is substituted for a solid device, this does not markedly improve the ease of insertion of the device into the crown of the cap. The difficulty in insertion is due to the fixed size of the device and the difficulty in modifying the shape of the device so that it can be inserted into the cap. If such a device is forced into a cap, the act of insertion itself could crease, wrinkle or possibly damage the cap. Also, such a device may not include any aspects or features to allow it to conform to the shape of the inner surface of the crown of the cap while in place.

Another problem of using a hemispherically shaped device is that pressure is exerted over the entire inner surface of the cap, including the brim lining the bottom of the cap. Many caps include a device in the brim to allow adjusting the size of the cap to the wearer's head. Using a device that applies force to the brim may damage or cause premature failure of the cap due to failure of this adjustment device.

BRIEF SUMMARY OF THE INVENTION

The current invention is a device that, when in place in the crown of a baseball, sports or similar cap, provides functionality in three areas considered particularly important to the owner of such a cap. The intended functionality of the device includes maintaining the shape of a cap into which it has been placed, prevention of deformation of the cap during transportation or storage and restoration of the shape of a cap that may have become deformed during use, storage or transport. The device is made of a resilient, but not necessarily compressible material and contains aspects and features to allow it to easily be inserted into the crown of a wide variety of baseball, sports and similar caps. The device is held in place by a friction fit between the top surface of the device and the inner surface of the cap's crown. As an option, the circular or oval circumference of the top surface as measured in the plane where the top surface joins with the bottom surface is smaller than its circumference measured in a plane located a distance up from the bottom surface of the device. The device's top surface tapers from its maximum circumference to its minimum circumference by varying only the size of each successive slice through the top surface of the device. The essentially circular or oval form of each slice through the top surface of the device is maintained throughout the taper. This method of maintaining the form of the top surface throughout the taper allows the device to maintain a tighter frictional fit against the inner surface of the crown of the cap while relaxing the force exerted against the cap's brim, without introducing any distortions to the form of the top surface that may induce wrinkles in the shape of the cap. This protects the cap's brim and any adjustment mechanism incorporated therein.

One aspect of this invention is exemplified by one or more compliance slots molded or cut into the top surface of the device. The slots effectively divide the top surface of the device into lobes. During installation, the user manipulates the device so that the material of the lobes moves into the space of the slots, allowing the device to easily slip into the cap. The user then releases the device to allow it to stay in place inside the cap. The slots allow the device to better comply to the shape of the cap both during the installation process and while the device is installed inside the cap. This aspect of the invention facilitates the capability of the cap shape supporting and form maintaining device to belier comply to the different sizes, shapes and contours of caps.

During installation of the cap shape supporting and form maintaining device, the user has a selection of methods to use to facilitate easy placement of the device into the cap. One such method is to simply place the cap over the device and push the cap into place on the device. Another method incorporates the use of insertion holes molded or cut into the bottom surface of the device. Each lobe of the top surface of the device has one insertion hole associated with it. Each lobe's insertion hole is located essentially below the center of the lobe and extends upward, into the device. To insert the device into a hat, the user inserts their thumb and fingers into the insertion holes and applies pressure to urge the tips of the finger and thumb together. This action flexes the material of the lobes of the device into the volume of the compliance slots described above, easing the insertion of the device into a cap. Once the device is fitted in place against the inner surface of the crown of the cap and the fingers and/or/thumb removed, the pressure exerted by the lobes of the cap shape supporting and form maintaining device against the inner surface of the cap crown helps to enforce and maintain the shape and condition of the cap.

BRIEF DESCRIPTION OF THE DRAWINGS

The Figures show different aspects of a preferred embodiment of the invention and how it is installed or applied to the cap to be shaped or preserved.

Figure 1:
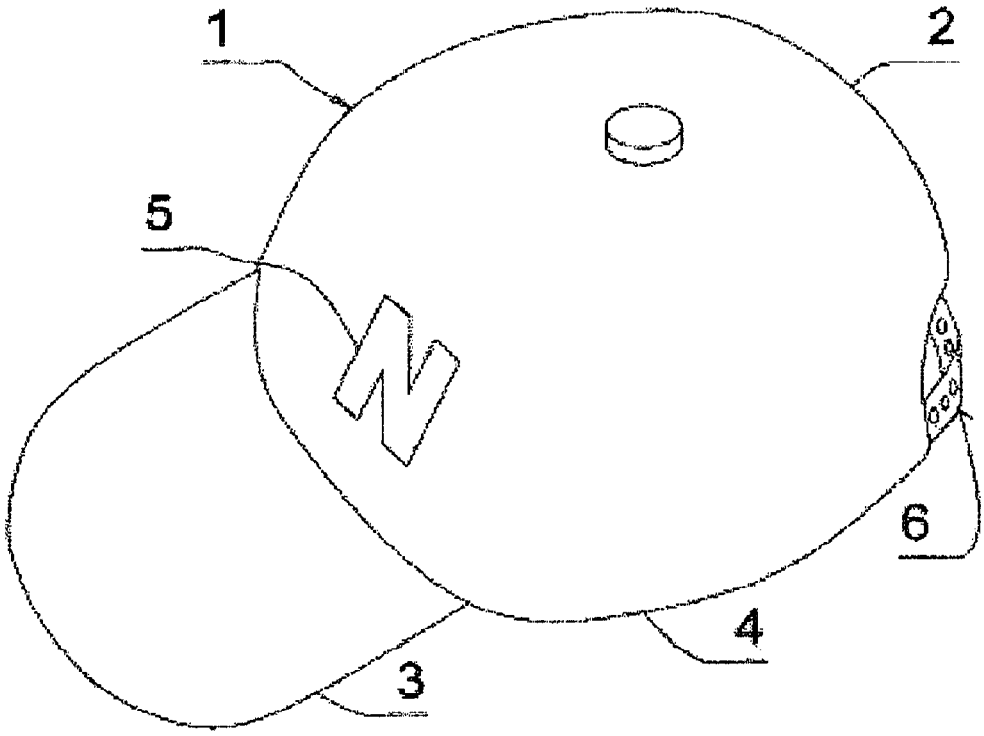
FIG. 1 illustrates a view of what is considered to be a typical baseball cap, similar in style to those encountered every day.

Certain features of interest are denoted by numeric designations in the illustrations.

1—A representative baseball or sports cap.

2—The crown of the representative baseball or sports cap.

3—The visor or bill of the representative baseball or sports cap.

4—The brim or base of the representative baseball or sports cap.

5—Display area on the representative baseball or sports cap.

6—Representation of a typical size adjustment mechanism on a representative baseball or sports cap.

10—The hat shape supporting and form maintaining device, or "HatNoodle".

11—The first or bottom surface of the device.

12—The second or top surface of the device.

14—Compliance Slots in the top surface of the hat shape supporting and form maintaining device.

15—Insertion Holes in the bottom surface of the hat shape supporting and form maintaining device.

16—Lobes in the top surface of the hat shape supporting and form maintaining device.

18—The central axis of the hat shape supporting and form maintaining device.

22—Illustration of how insertion holes terminate inside the HatNoodle device.

24—Center of first or bottom surface of the hat shape supporting and form maintaining device.

32—Center of second or top surface of the hat shape supporting and form maintaining device.

33—The plane wherein the circumference of the top surface of the HatNoodle reaches its maximum value.

34—Front Lobe of second or top surface of the hat shape supporting and form maintaining device.

35—The plane wherein the top surface of the HatNoodle meets the bottom surface at the base of the device.

DETAILED DESCRIPTION OF A PREFERRED EMBODIMENT OF THE INVENTION

Introduction:

In order to obtain a thorough understanding of the invention, a detailed description of a preferred embodiment of the invention is described here. This description relies on and refers to the drawings. Specific parts of the drawings are assigned a number and are referenced by that number. The drawing references will attempt to be consistent as possible. The present invention is particularly applicable to baseball or sports caps and the like, and is described herein with references to such caps. However, the device is also useable with other types of hats or headgear in addition to the sports or baseball caps described herein. Additionally, the device is useful not only during the transportation of caps, but also during their storage or display.

The Manner of Cap Used in a Preferred Embodiment of the Invention:

FIG.1 illustrates a baseball or sports cap 1. This cap 1 is representative of a large plurality of designs available. The representative cap 1 essentially comprises two major sections, the crown 2 and the visor or bill 3. The crown 2 of the cap 1 is of an essentially hemispherical shape, that is currently manufactured in a very wide range of shapes, styles and sizes to fit a wide range of user's heads. The brim 4 of the cap 1 proceeds around the base of the crown 2. The bill or visor 3 attaches to the brim 4 of the cap 1 at its front. The front area of the cap 1 may contain a relatively flattened display area 5 where a logo, team insignia, message, etc may be applied, attached or impressed on the cap 1. The rear of the cap 1 may contain an adjusting apparatus 6 that allows the user to changes the cap 1 size for a better fit. Additional aspects of the cap 1 such as buttons, embroidery, and other primarily decorative and optional items are sometimes attached to the crown 2. The presence or absence of these decorative items does not affect how the cap shape supporting and form maintaining device 10 is used.

Figure 2:
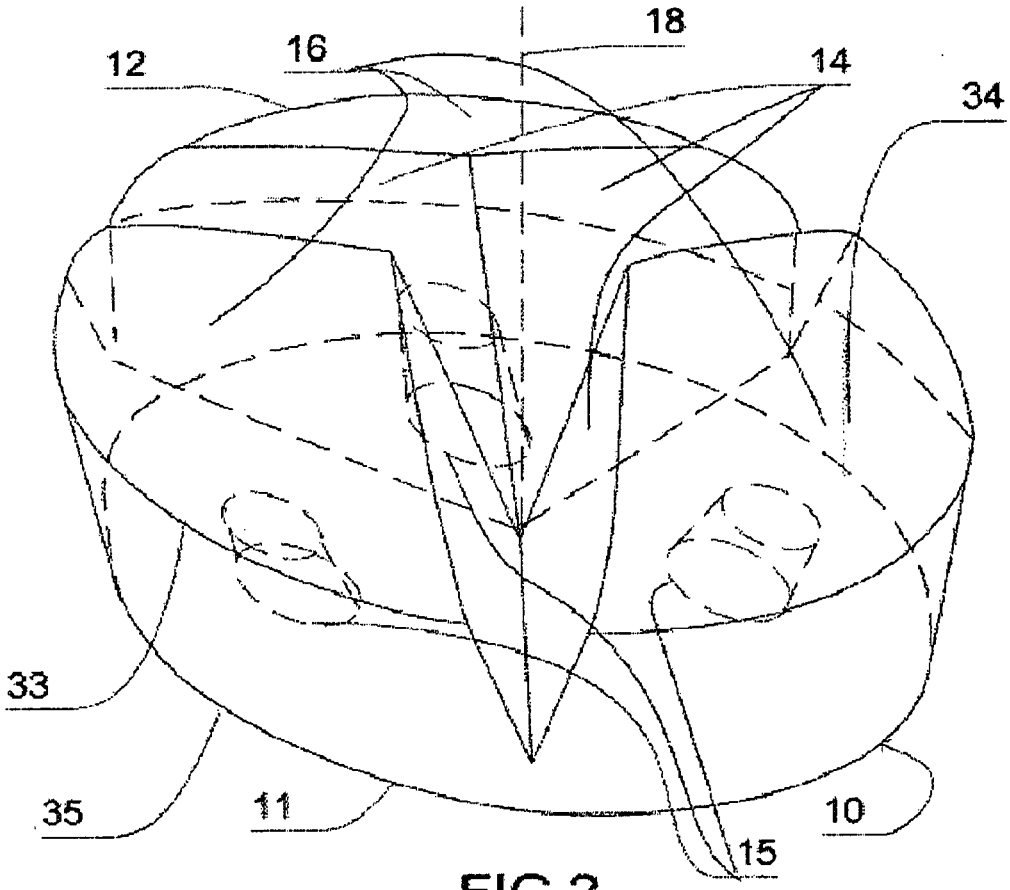
FIG. 2 illustrates a view of a preferred embodiment of the cap shape supporting and form maintaining device.

The Cap Shape Supporting and Form Maintaining Device:

FIG. 2 illustrates a preferred embodiment of the cap shape supporting and form maintaining device or HatNoodle 10. In a preferred embodiment, the invention relates to a device 10 with a bottom, or first surface 11 and a top or second surface 12 that is essentially hemispherical in shape. The shape of the top surface 12 of the device 10 facilitates the conformance of the top surface 12 to the shape of the inside surface of the crown 2 of the cap 1. In a preferred embodiment of the cap shape supporting and form maintaining device 10, the top surface 12 is somewhat oval in shape. In a preferred embodiment of the device, there are three compliance slots 14 in the top surface 12 of the device 10. The compliance slots 14 divide the top surface 12 of the device 10 into three lobes 16. The device 10 is usually inserted into the cap 1 so that the front lobe 34 of the device 10 is aligned with the visor 3 and display area 5 of the cap 1. In a preferred embodiment of the device 10, there are three insertion holes 15 in the bottom surface 11 of the device 10.

In a preferred embodiment of the device 10, the circumference of the top surface 12 of the device 10, as measured in a series of planes parallel to the bottom surface 11 of the device 10, achieves its minimum value when measured in the plane where the top surface 12 and bottom surface 11 of the device 10 meet at the base 35 and its maximum value when measured in a plane spaced a distance above the bottom surface 33. The shape of the top surface 12 of the device 10 in each plain does not vary from its essentially oval or circular shape, but in circumference. More particularly, the circumference of the device 10, as measured in a series of planes, each plane being parallel to the device's bottom surface 11 and each plane being placed at a successively greater distances above the devices bottom surface 11, increases in a continuous manner with the distance of the plane above the device's bottom surface 11, and reaches a maximum value when measured in a plane spaced a distance 33 above the bottom surface 11. This tapering of the circumference allows the device 10 to maintain a tighter frictional fit against the inner surface of the crown 2 of the cap 1 while relaxing the frictional fit against the brim 4 of the cap 1, protecting it and any adjustment mechanism incorporated therein 6. The maintenance of the essentially oval or circular shape of the top surface 12 of the device 10 as it tapers from its plane of maximum circumference 33 to its plane of minimum circumference 35 is important, since any change or distortion in the shape of the top surface 12 of the device 10 may cause creases or wrinkles in the cap 1.

The approximate dimensions of the cap shape supporting and form maintaining device or HatNoodle 10 are in the range of 12-36 cm in the front to back dimension, 10-30 cm in the side to side dimension and 6-20 cm in height. The circumference of the top surface of the device 10, when measured at the base of the device 35 is five to twenty-five percent smaller than the maximum circumference measured in a plane a distance above the bottom surface of the device 33. In a preferred embodiment of the device, 10 the circumference expands in a linear fashion from its minimal value at the base 35 of the device 10 to its maximum value in a plane 33 located a distance above the base 11. This feature of the circumference of the device 10 expanding in a continuous and linear manner from its minimum value to its maximum value, without distorting or modifying the essentially oval or circular shape of the top surface 12 is important. Introducing a modification that does not preserve the oval or circular outline of the device, or introducing an abrupt or discontinuous change in the shape of the device may introduce creases or wrinkles in a cap 1 used with the device 10.

Besides the basic convex or hemispherical shape of the top surface 12 of the device, an oval shape allows the device to more exactly conform to the shape of a baseball, sports or similar cap 1. In a preferred embodiment, the invention can also be practiced with a true hemispherical shape.

In a preferred embodiment, the cap shape supporting and form maintaining device or HatNoodle 10 is comprised of a resilient and flexible material. The lack of a requirement for compressibility in the material of the device allows using a larger range of materials and construction techniques in manufacturing the device. The ability to function using an essentially non-compressible material is due chiefly to the compliance slots 14 in the device's top surface 12 that assist in the flexing of the device 10 as it is inserted into and removed from the cap 1.

Some examples of materials suitable for the device's composition include natural and synthetic rubbers, including isoprene, latex and polyurethane. Other suitable materials for the devices construction could also include such materials as butadiene, butyl, chlorobutyl, chlorinated polyethylene, chlorosulphonated polyethylene, ethylene propylene, nitrile, polychloroprene, polyurethane and styrene butadiene polyethylene rubber and plastic compounds and combinations thereof The breadth of the list is not intended to be exhaustive, but illustrative of the large variety of materials suitable for use in the construction of the device.

The device may be constructed from a solid block of the chosen material. Open or closed cell foamed compositions may also be used in the construction of the device to lighten its weight. One example of such a resilient, flexible material suitable for use in the device is an open-celled foam rubber such as polyurethane foam rubber. The device may also be fabricated using other resilient materials of either open-cell or closed-cell foamed construction. The use of a solid material in the fabrication of the device is possible if the chosen material is sufficiently flexible and resilient to allow the compliance slots 14 in the top surface 12 of the device to move as the device is fitted into a cap 1. To decrease the weight of the device 10, Holes or voids in the material of the device could be included to reduce the device's weight. An essentially hollow construction would be another method to reduce the weight of the cap shape supporting and form maintaining device 10. In this hollow construction, even cardboard could be a suitable material for use in the construction of the device 10.

The ability to use a solid material in the construction of the cap shape supporting and form maintaining device or HatNoodle 10 is possible because of the aspects and features of the device 10. These aspects and features combine to allow the cap shape supporting and form maintaining device 10 to be easily fitted into a cap 1 without compressing the device 10. Once inserted the device 10 will conform to the shape and size of the crowns of different sized and shaped caps 1 and be compliant with the shape of the inner surface of the cap 1.

Figure 3:
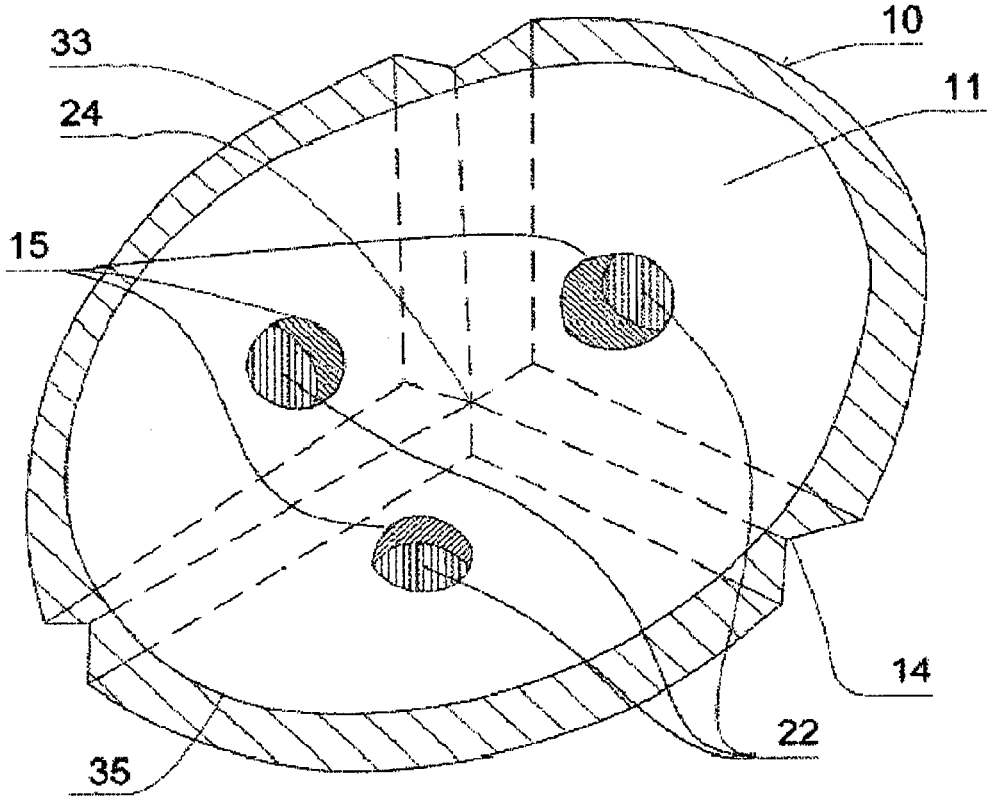
FIG. 3 illustrates a view, from the bottom, of a preferred embodiment of the hat shape supporting and form maintaining device. One embodiment of the optional insertion holes in the bottom surface of the device is also illustrated.

FIG. 3 shows a view of the bottom surface 11 of a preferred embodiment of the cap shape supporting and form maintaining device or HatNoodle 10. In a preferred embodiment of the device 10 there are three insertion holes 15 in the bottom surface 11 that extend upward into the body of the device 10. The insertion holes 15 do not extend completely through the device 10 to form channels from the bottom surface 11 to the top surface 12 of the device 10, but terminate in the device's interior 22. An aspect of the insertion 15 holes is that they can be used to facilitate the insertion of the device 10 into a cap 1. The presence of the insertion holes 15 is considered an option since the invention may be practiced without them.

That the insertion holes 15 in the bottom surface 11 of the device 10 do not extend entirely through to the top surface 12 of the device 10 is significant. The presence of openings in the top surface 12 of the device 10 could create wrinkles and creases in the crown 2 of a cap 1 set upon the device 10. The absence of holes in the top surface 12 of the cap shape supporting and form maintaining device 10 removes this possible cause of wrinkles or creases.

Again, referring to FIG. 3, there are three essentially cylindrical insertion holes 15 positioned equally around the central axis 24 of the essentially hemispherical top surface 12 of a preferred embodiment of the cap shape supporting and form maintaining device 10. Additionally, in a preferred embodiment of the cap shape supporting and form maintaining device 10, the three insertion holes 15 are approximately 2.54-cm (1inch) wide. Still more additionally, in a preferred embodiment of the cap shape supporting and form maintaining device 10, each of the insertion holes 15 are positioned so that the central axis of each insertion hole 15 is aligned in a direction pointing slightly away from the central axis 18 of the cap shape supporting and form maintaining device 10. Still more additionally in a preferred embodiment of the cap shape supporting and form maintaining device 10, the insertion holes 15 extend about 4-7 cm into the bottom surface 11 of the device 10. In a preferred embodiment of the device 10, the insertion holes 15 taper as they proceed into the interior and terminate in circles 22 that are slightly smaller than the openings in the bottom surface 11 of the device 10. In a preferred embodiment of the cap shape supporting and form maintaining device 10, the insertion holes 15 are spaced evenly around the centeral axis of the device 18.

The disclosure of the shape and configuration of the insertion holes 15 in the bottom surface 11 of the cap shape supporting and form maintaining device 10 is intended to illustrate a preferred embodiment of the device 10. However, this is not intended to limit the permitted shapes, permitted positioning, permitted number, or otherwise limit the permitted configurations of the insertion holes 15 that can be included when practicing this invention. To elaborate on this, alternative embodiments of the invention may include insertion holes 15 that are not round but are oval or other curved shapes, or are square, triangular, rectangular or any other flat-sided or polygonal shapes or are shapes that include combinations of curves, flat-sides and polygons. Also, the insertion hole 15 depth may range from 5% to 95% of the device 10 thickness. Additionally, two to six insertion holes 15 may be included and the insertion holes 15 may be distributed non-symmetrically about the central axis 18 of the device 10 or may not be aligned with the central axis 18 of the device 10 at all. More additionally, the width of each insertion hole 15 can range from 1.0 to 4.0 cm. More additionally, the insertion holes 15 may extend in directions that do not point toward the central axis 18 of the device 10, but may point in a different direction and the insertion holes 15 may even intersect one another. More additionally, the invention can also be practiced using insertion holes 15 that are not matched in size, shape or configuration, but may include combinations of the various insertion hole 15 configurations and sizes described herein. Even more additionally, the invention may be practiced without the insertion holes 15.

Figure 4:
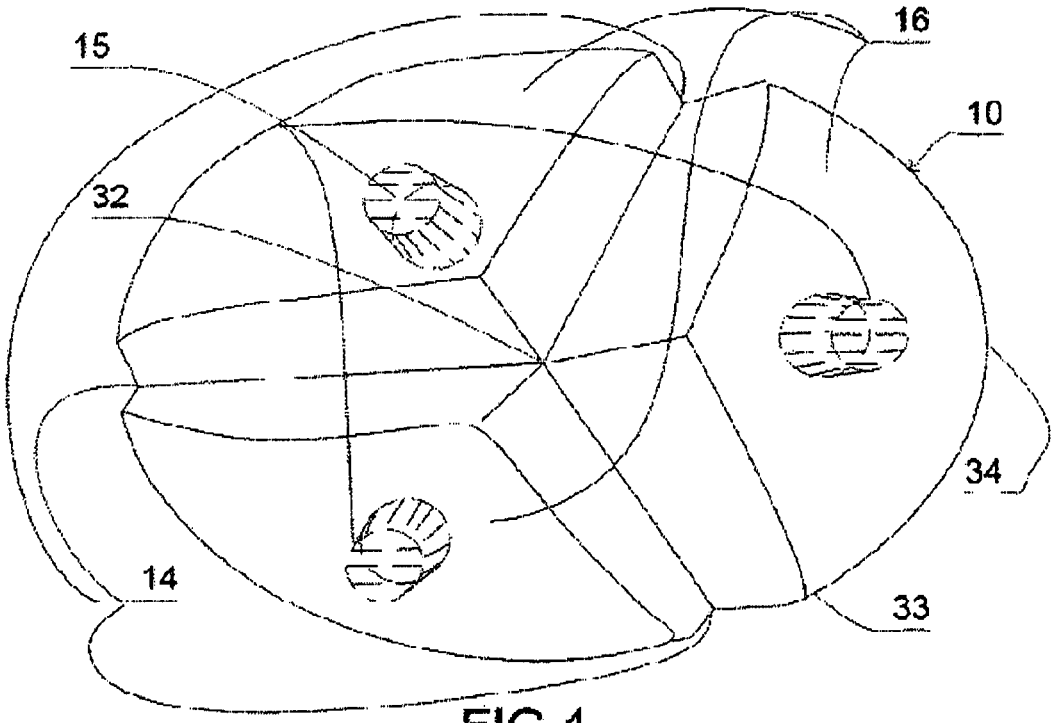
FIG. 4 illustrates a view, from the top, of a preferred embodiment of the hat shape supporting and form maintaining device. The compliance slots in the top surface of the device are visible in this view.

FIG. 4 shows a plurality of compliance slots 14 in the top surface 12 of the cap shape supporting and form maintaining device or HatNoodle 10. These compliance slots 14 aid in the insertion of the device 10 into a cap 1 and in the manner the top surface 12 of the device 10 complies with the shape of the inner surface of the crown 2 of the cap 1. In a preferred embodiment of device there are three "V"-shaped compliance slots 14. In a preferred embodiment of the device 10, the "V"-shaped compliance slots 14 are approximately 4.5 cm (1.75 inch) wide at the top surface 12 of the device 10 and taper linearly as they proceed into the material of the device 10 to end approximately 4.5 cm (1.75 inches) into the interior of the top surface of the device 10. In a preferred embodiment of the cap shape supporting and form maintaining device 10, the compliance slots 14 begin at the central axis 18 of the too surface 12 of the device 10 and proceed radially outward toward the periphery 33 of the top surface 12. One feature of the compliance slots 14 is that they divide the surface 12 of the hat shape supporting and form maintaining device 10 into lobes 16. In a preferred embodiment of the device 10, the three compliance slots 14 divide the tons surface 12 of the device 10 into three lobes 16, with the front lobe 34 positioned to support the front display area 5 of the crown 2 of the cap 1 while the other two lobes support the sides and meet at the rear section of the device 10. In a preferred embodiment of the cap shape supporting and form maintaining device or HatNoodle 10, each insertion hole 15 in the bottom surface 11 of the device 10 is positioned beneath the center of one of the lobes 16 formed by the compliance slots 14 in the top surface 12. In other words, when the device 10 is viewed from the top surface 12 as shown in FIG. 4, the insertion holes 15 and the compliance slots 14 are positioned evenly around the device's central axis 18 in a pattern that alternates between compliance slots 14 and insertion holes 15.

An important aspect of the compliance slots in the top surface 12 of the cap shape supporting and form maintaining device 10 is that they provide features and aspects that facilitate the compliance of the top surface 12 of the device with the shape of the inner surface of the crown of the cap 1. This compliance allows the cap 1 to be easily fitted onto the device 10. As a cap 1 is fitted into place onto the device 10 it flexes so that the lobes 16, whose boundaries are defined by the compliance slots 14 and the outline of the device 10, move into the voids of the compliance slots 14, effectively reducing the circumference of the top surface 12 of the device 10 so that it may comply with the shape of the inside surface of the crown 2 of the cap 1: This allows the cap 1 to slide into place over the device 10 and greatly facilitates the installation of a cap 1 onto the device 10. The aspect of the device 10 wherein its circumference tapers to a smaller value at the bottom surface 11 of the device 10 also aids in fitting the device 10 into a cap 1.

Another feature of the compliance slots 14 is that they allow the device 10 to flex after it is in place inside the cap 1. This flexing allows the device 10 to better conform to the shape of the inside of the crown 2 of the cap 1. This, in turn, allows the device 10 to better conform to a wider range of cap shapes and sizes than a device 10 lacking the compliance slots 14. The flexing of the compliance slots 14 in the top surface 12 of the cap shape supporting and form maintaining device or HatNoodle 10 also allows it to be easily removed from a cap 1. If the insertion holes 15 in the bottom surface 11 of the device 10 are present, the compliance slots 14 work in combination with the insertion holes 15 to aid in the insertion and removal of the device 10 into and from the cap 1.

The cap shape supporting and form maintaining device 10 may also be practiced with other configurations of compliance slots 14 including curved or spiral slot arrangements. Other manifestations of the slots such as a slitted or "U"-shaped, or other shaped compliance slots 14 can be used in place of, or in addition to, the "V"-shaped compliance slots described in a preferred embodiment of the cap shape supporting and form maintaining device 10.

The size of the compliance slots 14 can also vary so that the width of the compliance slots 14 on the top surface 12 of the device 10 may be from one cm to eight cm wide. The taper of the compliance slots 14 as they proceed into the material of the cap shape supporting and form maintaining device 10 can also vary from the essentially linear taper present in a preferred embodiment. It is the functionality of the compliance slots 14 in facilitating how the device 10 is inserted into and removed from a cap 1 and their functionality while inserted in the cap 1 that shows the utility of this aspect of the invention.

Figure 5:
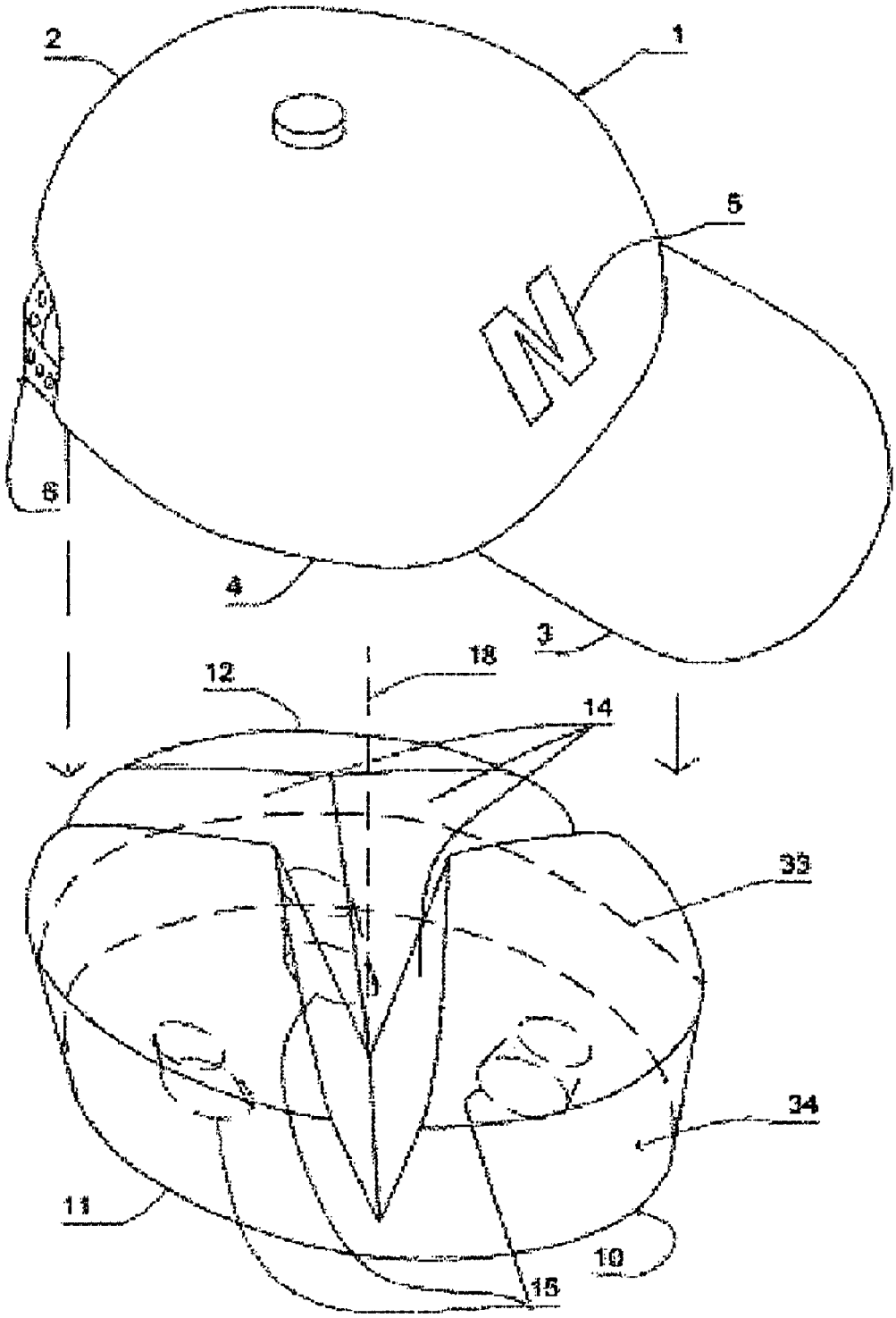
FIG. 5 illustrates how a typical baseball or sports cap may be fitted over a preferred embodiment of the hat shape supporting and form maintaining device.

The manner in which a preferred embodiment of the device 10 may be used with a representative cap 1 is shown in FIG. 5. This illustration shows how the cap 1 is fitted over the device 10. The front of the cap 1, containing the visor 3, and the display area 5 is aligned with the front lobe 34 of the device 10. The brim 4 of the cap 1 is Dressed onto the device 10. The device 10 responds to this pressure by flexing so that the material of the lobes 16 moves into the volume of the compliance slots 14. This allows the cap 1 to easily slip ever the device 10 into place.

In addition to supporting the shape and maintaining the form of the cap 1, the tension created by the interaction of the cap 1 and the cap shape supporting and form maintaining device or HatNoodle 10 helps the combination of the two resist external forces that may be applied to the cap 1 and device 10 during transport, display or storage. This is assisted by the aspects of the compliance slots 14 in the top surface 12 of the device 10 that allows the equalization of the shaping forces exerted by the device 10 against the inside of the crown 2 of the cap 1. This equalization of forces helps to minimize the formation of creases or wrinkles that could otherwise be caused by the continued presence of the cap shape supporting and form maintaining device inside a cap 1.

Another procedure for inserting the device 10, this time containing the optional insertion holes 15 in the bottom surface 11 of the device 10, into a cap 1 is characterized by the user inserting three fingers (with the thumb considered a finger) into the insertion holes 15. The user then applies pressure to the insertion holes 15 to cause the cap shape supporting and form maintaining device 10 to flex so that the material of the lobes 16 moves into the volume of the compliance slots 14. This action temporarily reduces the size or circumference of the upper part of the top surface 12 of the device 10, facilitating an easy insertion of the device 10 into a cap 1.

The device 10 is then inserted into the cap 1 while in its reduced size state and placed against the inner surface of the cap's crown 2. After positioning the device 10, the user releases or relaxes their grip on the insertion holes 15. This causes the top surface 12 of the device 10, due to the resiliency and flexibility of the material comprising it, to attempt to regain its original shape. As it does, the top surface 12 of the device 10 presses against the inside surface of the crown 2 of the cap 1. The crown 2 of the cap 1 resists the force of the device 10 pressing against it, creating a tension between the device 10 and the crown 2 of the cap 1. This tension serves to shape and form the cap 1. The compliance slots 14 in the top surface 10 of the device 10 aid in creating this tension between the device 10 and the crown 2 of the cap 1. Because the circumference of the top surface 12 of the device 10 tapers as it nears its junction with the bottom surface 11 of the device 10, a reduced amount of tension or pressure is exerted against the brim 4 area of the cap 1, protecting both the brim 4 from being stretched and the size adjustment mechanism 6 commonly incorporated into the cap's brim 4 from being damaged.

Fabrication of the Cap Shape Supporting and Form Maintaining Device:

Many methods may be used in the fabrication and production of the cap shape supporting and form maintaining device or HatNoodle 10. One method would employ the use of single-cavity or multiple-cavity injection molds. An advantage of this method of manufacture is that the inside of the mold may be treated with a compound prior to the injection stage. These compounds include surfacing agents that impart a desired surface on the device, releasing agents for freeing the device from the mold after injection, coloring agents applied to the surface of the device, or other compounds selected to impart a desired feature to the device, or to aid in the manufacturing process.

As part of the fabrication process, the other structures present in the device such as the optional insertion holes 15 in the bottom surface 11 of the device 10 and the compliance slots 14 in the top surface 12 of the device 10 must be created. The features or aspects required to create these structures may be incorporated into the molds used during the injection molding process, or they may be created by additional operations performed on the devices after the injection molding stage. Specifically, it may be easier to form a narrow slit or a slanted hole in the cap during a post-injection step than to design a mold capable of producing the features.

Other manufacturing methods besides injection molding may be used to produce the cap shape supporting and form maintaining device 10. One such method involves fabricating the device 10 from a mass of the resilient material and then shaping it by shaving or otherwise forming it to the desired shape. This manufacturing method may require extra operations to create the insertion holes 15 in the bottom surface 11 of the device 10 and the compliance slots 14 in its top surface 12. Extra surface finishing operations may also be required. Another production method would use a blow molding process to produce the hollow versions of the device 10 described.

The preceding description of a preferred embodiment of the invention was presented to illustrate and describe the invention. This description was not intended to be, and should not be interpreted as being, a complete listing of all possible aspects and features of the invention. Nor was it intended to limit the scope of the invention to the exact embodiment or embodiments disclosed therein. The disclosure contains a description of the embodiment chosen to best illustrate the invention and how it is constructed so that a person having ordinary skill in the art may practice it. To this person having ordinary skill in the art, many modifications to, embodiments of and variations on the invention would be obvious in light of the above teachings and disclosure. All such embodiments, modifications and variations that fall within the scope of the appended claims are considered within the scope of the invention to the extent that is fair, legal and equitable.

We claim:

1. A shape supporting and form maintaining device for baseball and sports caps, said caps comprising a crown section and a visor section:

said device comprised of a resilient material;

said device comprising at least two surfaces;

wherein said surfaces comprise a bottom surface having an essentially flat shape;

wherein said surfaces comprise a top surface having an essentially convex shape that substantially corresponds to the essentially concave shape of the inside surface of said crown section of cap;

wherein said top surface meets said bottom surface at the base thereof;

wherein the cross section of said top surface, when examined in a plane parallel to said bottom surface, is essentially circular or oval in shape;

wherein said top surface includes a plurality of compliance slots therein for aiding the compliance of the shape of said top surface of device with inside surface of said crown section of cap;

wherein each of said compliance slots begin at a center point of said top surface of device and proceed radially in a straight line toward the peripheral edge of the device;

wherein said compliance slots comprise three "V" shaped slots;

wherein said compliance slots divide said top surface of device into three essentially equally sized lobes, one lobe positioned at the front end of said device;

wherein said lobe positioned at the front end of the device is designated for placement next to front area of said crown of cap;

wherein the circumference of said top surface, when measured in a plane located at said base thereof, is less than the circumference of said top surface measured in a plane located a distance above said base;

wherein said circumference of top surface varies continuously from value measured in said plane located at said base thereof to value measured in said plane located a distance above said base;

wherein the cross section of said top surface of device, when inspected in any plane located between said base of device and said distance above base of device, maintains its essentially circular or oval shape;

wherein said bottom surface further comprises three insertion holes wherein:

each insertion hole originates in said bottom surface of device, extends therein and terminates in the interior of said device;

each insertion hole is positioned essentially beneath the center of one of said lobes in top surface of device;

whereby the shape of said cap is supported and its form maintained by said device inserted therein.

2. A shape supporting and form maintaining device for baseball and sports caps, said caps comprising a crown section and a visor section:

said device comprising a formed mass of material;

said material comprising a resilience means to facilitate the flexing of said device;

said device comprising at least two surfaces;

wherein said surfaces comprise a bottom surface having an essentially flat shape;

wherein said surfaces comprise a top surface having an essentially convex shape that substantially corresponds to the essentially concave shape of the inside surface of said crown section of cap;

wherein said top surface meets said bottom surface at the base thereof;

wherein the cross section of said top surface, when examined in a plane parallel to said bottom surface, is essentially circular or oval in shape;

wherein said top surface includes a plurality of compliance slots therein for aiding the compliance of the shape of said top surface of device with inside surface of said crown section of cap;

wherein each of said compliance slots begin at a center point of said top surface of device and proceed radially in a straight line toward the peripheral edge of the device;

wherein said compliance slots comprise three "V" shaped slots;

wherein said compliance slots divide said top surface of device into three essentially equally sized lobes, one lobe positioned at the front end of said device;

wherein said lobe positioned at the front end of the device is designated for placement next to front area of said crown of cap;

wherein the circumference of said top surface, when measured in a plane located at said base thereof, is less than the circumference of said top surface measured in a plane located a distance above said base;

wherein said circumference of top surface varies continuously from value measured in said plane located at said base thereof to value measured in said plane located a distance above said base;

wherein said circumference of top surface tapers in a linear fashion from value measured in said plane located a distance above said base to value measured in said plane located at the base thereof;

wherein the cross section of said top surface of device, when inspected in any plane located between said base of device and said distance above base of device, maintains its essentially circular or oval shape;

said device further comprising a bottom surface wherein said bottom surface comprises three insertion holes wherein:

each insertion hole originates in said bottom surface of device, extends therein and terminates in the interior of said device;

each insertion hole is positioned essentially beneath the center of one of said lobes in top surface of device;

whereby said insertion holes facilitate the insertion of said device into said cap;

whereby the shape of said cap is supported and its form maintained by said device inserted therein.

* * * * *